US011788214B2

(12) United States Patent
Krauss

(10) Patent No.: US 11,788,214 B2
(45) Date of Patent: Oct. 17, 2023

(54) WEBBING CONSTRUCTION

(71) Applicant: American Cord & Webbing Co., Inc., Woonsocket, RI (US)

(72) Inventor: Jordan Krauss, Providence, RI (US)

(73) Assignee: American Cord & Webbing Co., Inc., Woonsocket, RI (US)

( * ) Notice: Subject to any disclaimer, the term of this patent is extended or adjusted under 35 U.S.C. 154(b) by 31 days.

(21) Appl. No.: 17/707,289

(22) Filed: Mar. 29, 2022

(65) Prior Publication Data

US 2022/0316104 A1 Oct. 6, 2022

Related U.S. Application Data

(60) Provisional application No. 63/168,027, filed on Mar. 30, 2021.

(51) Int. Cl.
*D03D 13/00* (2006.01)
*D03D 1/00* (2006.01)
*D03D 15/573* (2021.01)

(52) U.S. Cl.
CPC ..... *D03D 1/0005* (2013.01); *D03D 15/573* (2021.01)

(58) Field of Classification Search
CPC .... D03D 1/0005; D03D 15/573; D03D 11/00; D03D 13/004; D10B 2505/122
See application file for complete search history.

(56) References Cited

U.S. PATENT DOCUMENTS 3,926,227 A * 12/1975 Takada ..... D03D 11/00 139/426 R
4,018,960 A * 4/1977 Berger ..... D03D 11/00 428/36.1
4,174,738 A * 11/1979 Berger ..... D03D 1/0005 139/432
4,313,473 A * 2/1982 Reiter ..... D03D 47/02 139/432
4,800,929 A * 1/1989 Watanabe ..... D03D 47/40 428/193
4,955,182 A * 9/1990 Newman ..... A01K 13/008 54/66
5,244,718 A * 9/1993 Taylor ..... A61B 46/00 229/87.01
5,436,044 A * 7/1995 Pinkos ..... D03D 11/02 139/411
6,283,167 B1 * 9/2001 Chang ..... D03D 11/00 139/383 R (Continued)

*Primary Examiner* — Robert H Muromoto, Jr.
(74) *Attorney, Agent, or Firm* — Hinckley, Allen & Snyder, LLP; David R. Josephs

(57) ABSTRACT

The webbing construction absorbs stress and pressures on the edge of the webbing. The webbing locks into various hardware or an adjustment bar along the length of the webbing, such as every 1/32" for slippage control of the webbing. The webbing of the present invention reduces the memory of folds made over a long period of time with a long shelf life. The webbing construction of the present invention can be used in a wide array of applications, such as for clothing belts, seat belt webbing, watch bands, backpacks, straps and the like. As a result, the webbing of the present invention addresses the shortcomings of the prior art to provide a superior webbing construction.

6 Claims, 5 Drawing Sheets

(56) References Cited

U.S. PATENT DOCUMENTS

| | | | | |
|---|---|---|---|---|
| 8,136,555 | B1 * | 3/2012 | Chang | D03D 11/00 139/384 R |
| 8,733,406 | B2 * | 5/2014 | Hannes | D03D 21/00 139/232 R |
| 8,770,235 | B2 * | 7/2014 | Wahhoud | D03D 31/00 139/192 |
| 9,827,944 | B2 * | 11/2017 | Brielmann | D03D 1/0005 |
| 10,582,756 | B2 * | 3/2020 | Au | A45C 13/30 |
| 10,675,490 | B2 * | 6/2020 | Blondeau | A62B 35/0006 |
| 11,313,055 | B2 * | 4/2022 | Perrin | D03D 13/004 |
| 2002/0117121 | A1 * | 8/2002 | Sporn | A01K 27/00 119/856 |
| 2008/0121305 | A1 * | 5/2008 | Metzger | A41B 11/005 36/43 |
| 2011/0250808 | A1 * | 10/2011 | Preus | D03D 1/0005 442/184 |
| 2011/0278906 | A1 * | 11/2011 | Shimazaki | D06M 15/227 297/475 |
| 2014/0232165 | A1 * | 8/2014 | Brielmann | B60R 22/12 139/11 |

* cited by examiner

WEAVE TYPE: 1X1 BINDER + 8 REGULAR WEAVE FINISH: GREIGE GOODS TO DYE

| LOOM SPECS: | | FINISHED SPECS: | |
|---|---|---|---|
| WIDTH: | 1-1/2" +1/16" | WIDTH/TOLERANCE: | 1-1/2" +/-1/32" |
| PICKS: | 31 | PICKS: | 33-35 |
| THICKNESS: | 0.085+/-.005 | THICKNESS: | 0.085+/-.005 |
| BREAK: | 5.500 | BREAK: | 5.500 |

| | #ENDS | DENIER | YARN | COLOR |
|---|---|---|---|---|
| WARP | 196 | 1680 | NYLON | NATURAL |
| WARP | 44 | 840 | NYLON | NATURAL |
| STUFFER | | | | |
| BINDER | 15 | 1680 | NYLON | NATURAL |
| BINDER | | | | |
| BINDER | | | | |
| FILL | 1 | 840 | NYLON | NATURAL |
| CATCH | 1 | 210 | NYLON | NATURAL |

REED 9.5

B
15X ( 20

HARNESS

| | | | | | | | | | | | | | | | | |
|---|---|---|---|---|---|---|---|---|---|---|---|---|---|---|---|---|
| 15 | | | | | | | | | | | | | | | 15 | |
| 14 | | | | | | | | | | | | | | | 14 | |
| 13 | | | | | | | | | | | | | | | 13 | |
| 12 | | | | | | | | | | | | | | | 12 | |
| 6X | | | | | 11 | | | | 11 | | | | | 11 | 5X | |
| | | | | | 10 | | | | 10 | | | | | 10 | | |
| | | | 9 | | | | 9 | | | | 9 | | 9 | | | |
| | | | 8 | | | | 8 | | | | 8 | | 8 | | | |
| | | 7 | | | | | | 7 | | | | 7 | | | | |
| | | 6 | | | | | | 6 | | | | 6 | | | | |
| | | | | 5 | | 5 | | | | 5 | | | | 5 | | |
| | | | | 4 | | 4 | | | | 4 | | | | 4 | | |
| | B | | | | | | | B | | | | | | | B | |
| | | | | | | | | 7 | X | | | | | | | |

FIG. 5

WEBBING CONSTRUCTION

CROSS REFERENCE TO RELATED APPLICATION

This application claims benefit to U.S. Provisional Patent Application Ser. No. 63/168,027, entitled WEBBING CONSTRUCTION, and filed Mar. 30, 2021, the entire contents thereof incorporated by reference herein.

BACKGROUND OF THE INVENTION

The present invention relates generally to a webbing construction, for example webbing construction for use in in the narrow fabrics industry that may be used for any purpose, such as for seatbelts, clothing belts, backpacks, tie downs, slings, tent & awning, military applications, medical and commercial product end uses.

In the field of webbings, there are currently no webbings in the market that can both lock into hardware with increased resistance to abrasion on the edge, top and bottom of the weave while spreading the overall stress induced by the webbing evenly along the entire piece of webbing.

There are no known webbing constructions that meet all of these performance factors without making some accommodation or sacrifice as the structure or method of manufacturing of the webbing construction. The webbing of the present invention has use in a wide array of uses, particularly for belt applications. For example, the webbing may be used in a garment belt that interacts and engages with a belt buckle. Second, the webbing of the present invention has use as a seat belt webbing where internal monofilament fibers for rigidity are not required, thereby saving costs.

There is also a need for a webbing construction that is easy and inexpensive to manufacture.

There is a further need for a webbing construction that includes integrated ridges for stepped or indexed control of the webbing, particularly when interacting and engaging with a belt buckle or other hardware.

There is yet another need for a webbing construction that is unique in appearance and aesthetically appealing.

SUMMARY OF THE INVENTION

In view of the foregoing, the present invention relates to a new webbing construction that can be configured and arranged to absorb stress and pressures on the edge of the webbing. The webbing is also configured to lock into a buckle or an adjustment bar along the length of the webbing, with spaced apart ridges, such as every 1/32" (inch) for superior control of the webbing. Thus, this allows the webbing not to slip and allows for adjustments on end uses every predetermined spaced distance, such as 1/32", which is naturally inherent to the configuration of the webbing. The webbing of the present invention is also constructed and configured to reduce the memory of folds made over a long period of time. Such a construction is particularly applicable in webbing for garment belts that releasably engage with a belt buckle component.

Moreover, the shelf life of the product is for life and is easy to manufacture. The webbing is preferably made on a narrow fabric needle loom but could be modified so it is capable of being made on other types of looms.

The present invention that meets all of the foregoing performance factors and needs of the webbing industry. For example, the webbing construction of the present invention can be used, for example, as the webbing in a garment belt and may be used as a seat belt webbing without the typically required monofilament fibers that is woven inside of the webbing to allow for reduced memory. The webbing of the present invention includes no such additional monofilament fibers or other structure for this purpose.

Accordingly, an object of the present invention is to provide a narrow fabric webbing which locks into hardware periodically along the length of the webbing, such as every 1/32".

A further object of the present invention is to provide a webbing construction that has high levels of abrasion resistance both on the edge and face of the webbing.

A further object of the present invention is to provide a webbing construction that is visually unique and aesthetically appealing with low memory.

Yet another object of the present invention is to provide a webbing construction that has high abrasion resistance.

Other objects, features and advantages of the invention shall become apparent as the description thereof proceeds when considered in connection with the accompanying illustrative drawings.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

FIG. 5 is a loom draft of the webbing construction of the present invention;

DESCRIPTION OF THE INVENTION

Figure 1:
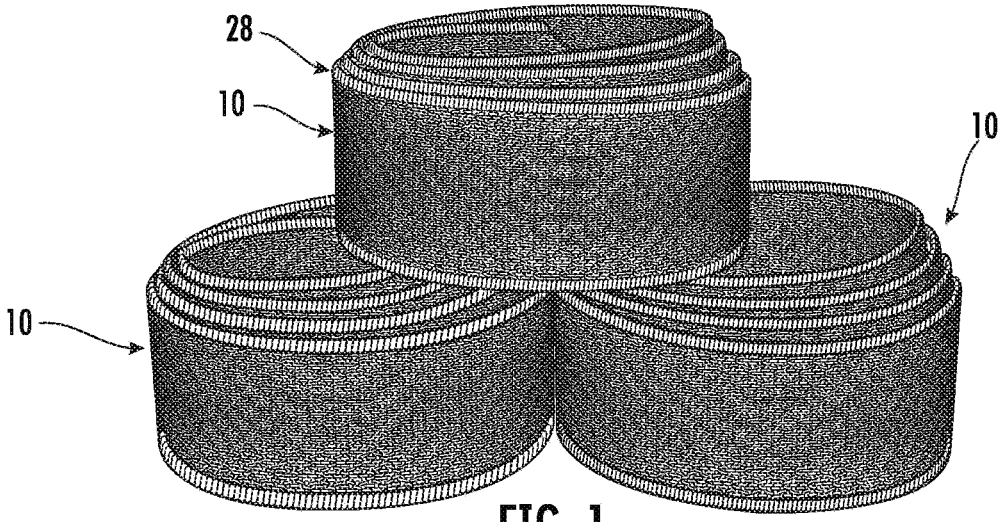
FIG. 1 is a front perspective of the webbing construction of the present invention shown in the example use as a garment belt webbing.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal.

The present invention is directed to a woven product such as fabric webbing 10, for example, having, amongst other things, performance factors and needs that exceed those of the current webbing industry. For example, the webbing construction 10 of the present invention is particularly well-suited for use as a belt, such as the webbing material 10 for a garment belt that interconnects and engages with a belt buckle, as seen representationally in FIG. 3. Also, the webbing 10 of the present invention has uses in other belt purposes, such as a seat belt and straps for backpacks (not shown).

Unlike prior art belt webbing, the webbing 10 of the present invention provides a narrow fabric webbing that locks into hardware periodically along the length of the webbing, such as every 1/32", as will be described in detail below. Further the present webbing provides a webbing construction 10 that has high levels of abrasion resistance both on the edge and face of the webbing. Moreover, the present invention provides a webbing construction 10 that is visually unique and aesthetically appealing with low memory.

Yet another advantage of the present disclosure is to provide a webbing construction 10 that has high abrasion resistance. As such, it should be appreciated that the product of the present disclosure has a wide range of useful applications including, but not limited to, bulk bags, belts (e.g., fashion, military, safety, sports, law enforcement, etc.), emergency rescue (e.g., fire, lineman, fall protection, first responders, etc.), back pack webbing, pet collars, pet leashes, leads, luggage straps, safety equipment and supplies, cargo/freight tie-downs, tow straps, lifting slings, aircraft and aerospace applications, mountaineering, rock climbing, ice climbing, automotive and recreational vehicle applications, child safety, harvesters and mowers, rifle slings, shoulder straps, boating and hunting applications, harnesses and halters, aquatic life preservers and other floatation devices, parachuting, surgical or other medical facility applications, other outdoor and recreational applications, burial or mortuary applications, etc.

The new and unique webbing 10 and method of manufacturing thereof, in accordance with the present invention, is shown in detail in the attached drawings figures and is described in detail below.

Turning first to FIG. 1, a front perspective of the webbing construction 10 of the present invention is shown. By way of example, three different color variants are shown (in shades of gray for illustration purposes only). It should be understood that the webbing can be made of any color, as desired.

Figure 2A:
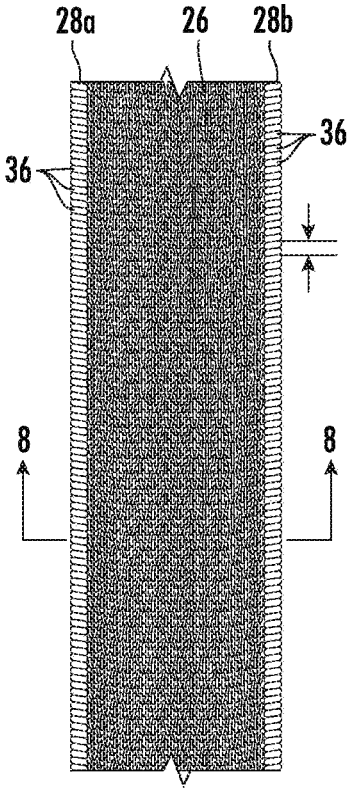
FIGS. 2A and 2B are top plan views of the webbing construction of FIG. 1 in different colors, which can be used as a garment belt webbing or for other belt purposes.
Figure 2B:
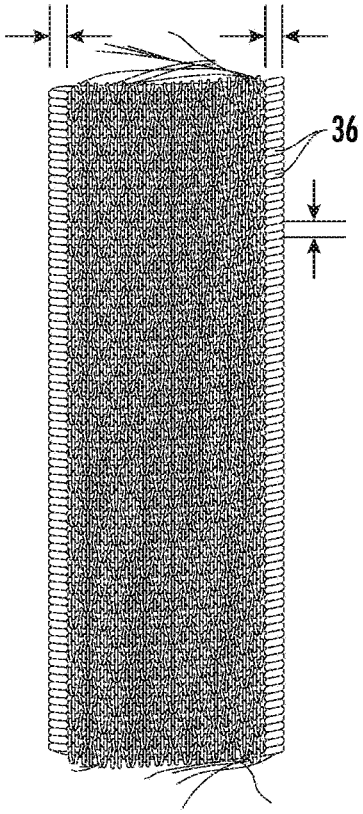
Figure 3:
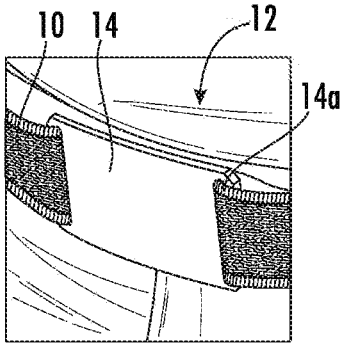
FIG. 3 is a perspective view of an example environment of where the webbing construction of FIG. 1 is used as webbing for a garment belt that engages with a belt buckle.
Figure 4:
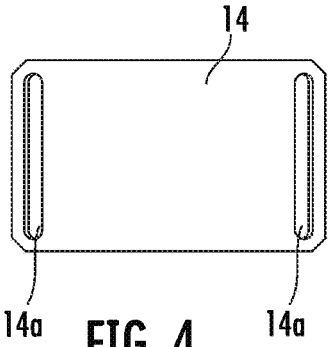
FIG. 4 is a buckle of the type that may be employed in a belt configuration that may use the webbing construction of the present invention.

FIGS. 2A and 2B are top plan views of the webbing construction 10 of FIG. 1, where FIG. 2A shows a lighter color than the webbing of FIG. 2B, for illustration purposes only. Otherwise, they are of the same construction. As seen in FIGS. 3 and 4, as an example of the application and use of the webbing 10 of the present invention, the webbing can be used as webbing 10 for a garment belt, generally referred to as 12. The use of the webbing of the present invention as a garment belt webbing is for illustration purposes only. It should be understood that the webbing of the present invention can be used for any other belt purposes. FIG. 3 shows a perspective view of an example environment of where the webbing construction 10 of FIG. 1 is used as webbing for a garment belt that engages with a belt buckle 14. FIG. 4 shows a buckle 14 of the type that is preferably employed in a garment belt configuration that uses the webbing construction 10 of the present invention.

Figure 7A:
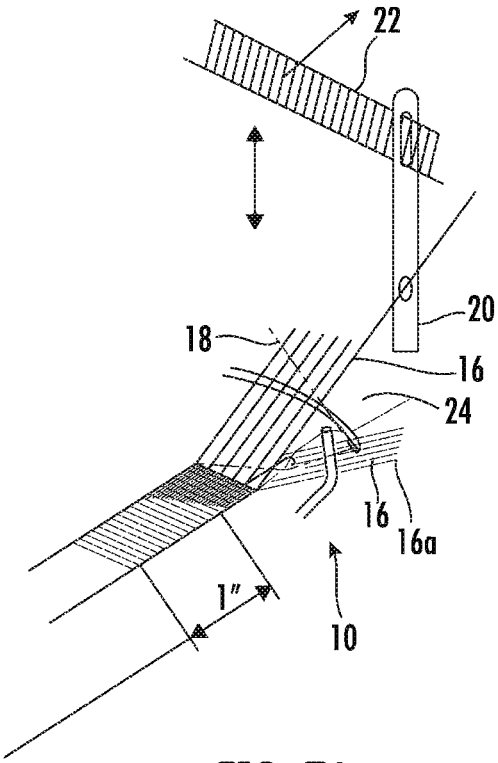
FIG. 7A shows a perspective view of the webbing construction of the present invention in the process of being woven.
Figure 7B:
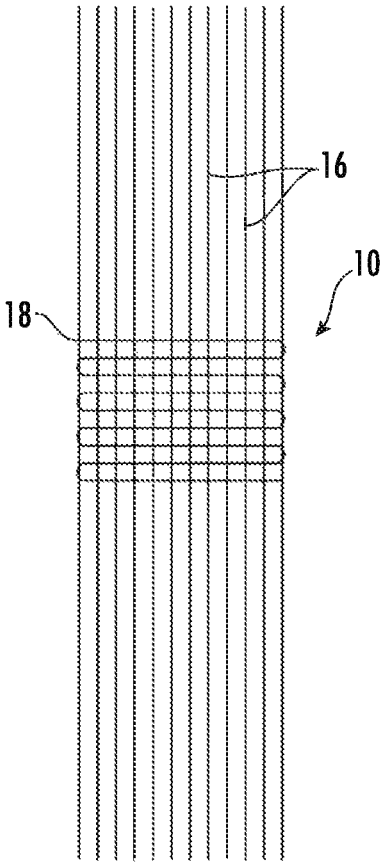
FIG. 7B shows a top plan view of the weft and warp threads used in the webbing construction of the present invention.

The present invention provides a new and improved webbing construction 10. By way of background, FIGS. 7A and 7B provide an overview of the construction of the webbing construction 10 of the present invention where vertically running warp threads 16 with respective warp ends 16*a* are provided. Weft threads 18 are also provided. Binder yarn, binder ends are also provided, as will be discussed in connection with FIG. 8 below.

More specifically, as in FIG. 7A, each warp thread 16 passes through a heddle 20 which is used to separate the warp threads 16 with unique design for the passage of the weft 18. The typical heddle 20 is suspended on a harness shaft 22 of a loom, the entire loom is not shown for ease of illustration in that general loom construction is so well known in the art. In weaving, warp threads 16 are moved up or down by the harness shaft 22 driven by a pattern chain. The horizontal weft thread 18 is an individual thread moving in and out into an open warp shed 24 and stitched on the right side by a latch needle and locked by a catch cord thread. Each insertion in and out is called one pick, namely, the number of weft ends per one inch is the number of picks, as is well known in weaving technology.

The construction of webbing 10 of the present invention is preferably based on double 2×2 twill weave of 1680 denier yarn bounded together by 1680 denier 1×1 binder. The edges of the webbing construction are preferably double plain weave of 840 denier yarn. Using one harness for binder, 8 harnesses for center body, 4 harnesses for edges. Alternatively, any suitable type of yarn may be used for other purposes. Please note that other denier yarns can be used to construct this construction of webbing.

Referring now to FIG. 5, a loom draft for the webbing construction 10 of the present invention is shown with details of the design features. The loom used for the manufacturing of the webbing preferably has a width of 1½"+1/16", a thickness of 0.085+/−0.005 inches and a break strength of 5,500 pounds. In the illustrated embodiment there are 31 picks used. The finished specifications of the webbing 10 can generally be a webbing with a width of 1½"+/−1/32", 33-35 picks, a thickness of 0.085+/−0.005", with a break strength of 5,500 pounds. While the yarn may be of any material, it is preferably made of nylon and of a natural color to provide greige goods that are suitable for dyeing, as desired.

Figure 6:
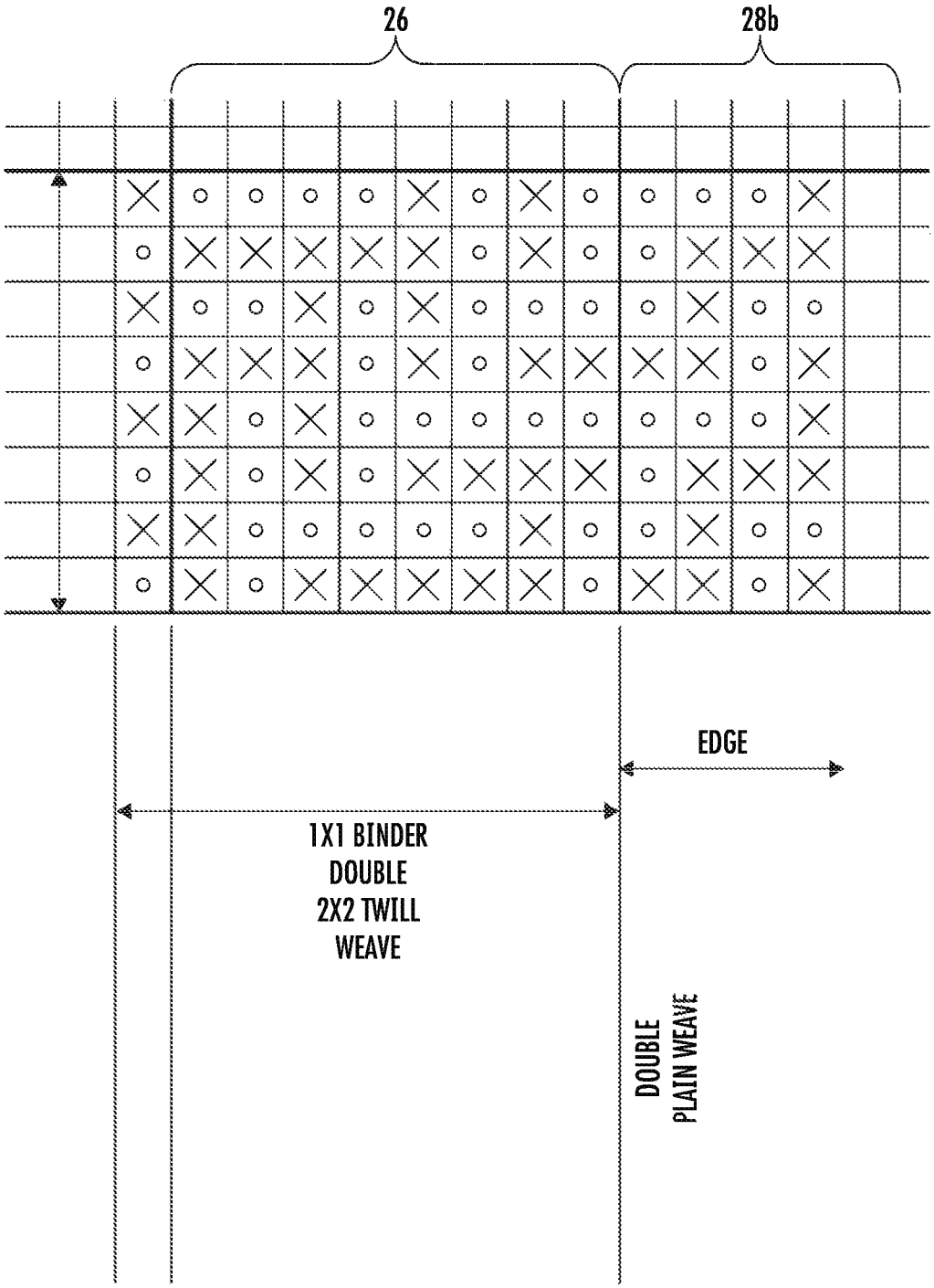
FIG. 6 is a chain draft diagram for fabricating the webbing construction of the present invention.

FIG. 6 is a chain draft diagram for fabricating the webbing construction 10 of the present invention to further illustrate the construction and method of manufacture thereof. Moreover, FIG. 8 shows a perspective detail view of the webbing construction 10 of the present invention through the line 8-8 of FIG. 2A.

Figure 8:
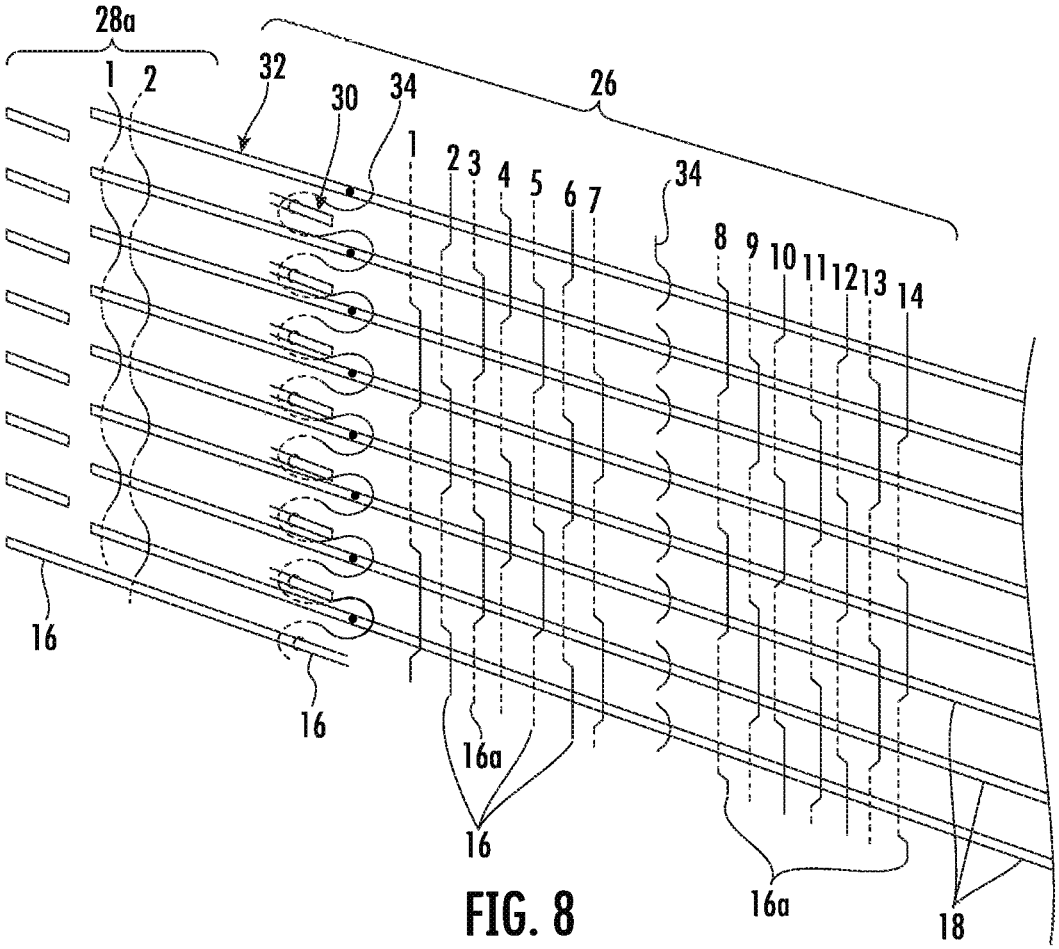
FIG. 8 shows a perspective detail view of the webbing construction of the present invention through the line 8-8 of FIG. 2A.

It should be noted that the loom draft of FIG. 5, chain draft diagram of FIG. 6 and the detail view of FIG. 8 would be understood by a person of skill in the art on how to weave the webbing 10 of the present invention. In accordance with FIGS. 5, 6 and 8, the following additional details are provided.

As seen in FIG. 5, the webbing that results from the foregoing fabrication method, is characterized by the pattern and harness diagram is shown. The various reference numerals positioned throughout the diagram represent the harness numbers of the loom. Accordingly, the woven webbing of the example of the present invention includes a B-5-4-5-4-B-5-4-5-4-B-7-6-7-6-7-6-9-8-9-8-9-8-11-10-11-10-11-10 weave pattern.

As seen by the chain draft diagram of FIG. 6, the foregoing fabrication method can be performed with a conventional loom such as a needle loom, a shuttle loom, a wooden loom, or generally any other loom or other known process. For example, the webbing 10 may be fabricated by programming the chains or cams of a conventional needle loom according to the chain draft diagram depicted in FIG. 6, wherein the chains or cams are shown as columns on the horizontal axis and the chain rows are shown as rows on the vertical axis. FIG. 6 depicts only a portion of the entire width W of the webbing for illustration purposes. An "X" in the chain draft diagram of FIG. 6 indicates an up pick, while a "•" indicates a down pick. As such, in FIG. 6, the chain draft includes first through eighth rows and first through thirteenth columns. The first row includes down picks in the fifth, seventh, ninth, tenth, eleventh, twelfth columns, and up picks in the first, sixth, eight, and thirteenth columns. The second row includes down picks in the first, seventh, ninth, and tenth columns, and up picks in the second, third, fourth, fifth, sixth, eight, eleventh, twelfth, and thirteenth columns. The third row includes down picks in the second, third, fifth, seventh, eighth, ninth, tenth, twelfth, thirteenth columns, and up picks in the first, fourth, sixth, and eleventh columns. The fourth row includes down picks in the first, fifth, seventh, and twelfth columns, and up picks in the second, third, fourth, sixth, eighth, ninth, tenth, eleventh, and thirteenth columns. The fifth row includes down picks in the third, fifth, sixth, seventh, eighth, ninth, tenth, eleventh, and twelfth columns, and up picks in the first, second, third, and thirteenth columns. The sixth row includes down picks in the first, third, fifth, tenth columns, and up picks in the second, fourth, sixth, seventh, eighth, ninth, eleventh, twelfth, and thirteenth columns. The seventh row includes down picks in the third, fourth, fifth, sixth, seventh, ninth, tenth, twelfth, and thirteenth columns, and up picks in the first, second, eighth, and eleventh columns. The eighth row includes down picks in the first, third, ninth, and twelfth columns, and up picks in the second, fourth, fifth, sixth, seventh, eighth, tenth, eleventh, and thirteenth columns.

Of note, in the diagram of FIG. 6, the first through ninth columns denote the main body 26 of the webbing 10. The main body 26 of the webbing is a 1×1 binder with a double 2×2 twill weave. The tenth through thirteenth columns represent an edge 28 of the of the webbing 10 and is a double plain weave. For clarity, the left edge portion of the webbing 10 is referred to as 28*a* and the right edge portion is referred to as 28*b*. The pattern in the center 26 of the webbing 10 of the present invention is preferably repeated seven times; however, the pattern may be repeated more or less number of times and still fall within the scope of the present invention.

Referring now to FIGS. 5, 6 and 8, the picks specification refers to the amount of weft thread per inch. The warp specification refers to the number of warp threads used needed to construct this type of webbing. The specification of 196 ends with a Denier (linear mass density) of 1680 is used to create the center of the webbing. The specification of 44 ends with a Denier 840 is used to make the opposing edges of the webbing of the present invention.

The webbing 10 of the present invention includes two weave layers, a bottom layer 30 and a top layer 32, which are joined by a binder yarn 34, as can be seen in FIG. 8. This binder yarn 34 travels from the top of the warp thread on the top twill weave 32 to the bottom of the bottom twill weave 30. The specification of 15 in FIG. 5 represents the number of yarn threads needed to join each layer 30, 32 and construct the webbing 10.

FIG. 5 also refers to FILL (filling), not shown for ease of illustration, which is the yarn that passes through the webbing 10 perpendicular the binder 34 and warp threads 16. The filling yarn is woven into the webbing 10 and connected to the webbing once caught by the latch needle. The filling is preferably applied each time the harnesses 22 shift up and down. An end of 1 and Denier of 840 is preferably employed for the filling yarn.

The catch is the lock thread located on the edge of the webbing 10 which is applied to the webbing 10 via the latch needle. An end of 1 and Denier of 210 is preferably employed for the catch lock thread. The catch thread is an option design feature. If a catch thread is not used, webbing will still fall within the scope of the present invention.

The REED reference of 9.5 in FIG. 5 represents the number of dents per inch on the front REED. The 15× specification refers to the number of dents used in total.

Preferably, in accordance with the present invention, the number of harnesses 22 employed is 13, as seen in FIG. 5. The first two harnesses 22 are skipped to allow for needed space. Thus, starting from right to left, the right woven edge 28*b* uses harnesses No. 12-15, repeating 5 times, until encountering the first binder thread 34. After this, a binder thread 34 is applied representing the end of the right edge 28*b* and the start of the center woven area 26. The center woven area 26 uses harnesses No. 4-11 starting with No. 10 and No. 11 after the binder 34 and ending with harness No. 7. Between each binder 34 the pattern preferably uses 14 warp threads. Once the pattern has repeated 7 times, a single binder thread 34 is applied before beginning the left woven edge 28*a* of the webbing 10. Further, the left woven edge 28*a* requires 4 harnesses which are No. 12-15 and repeats 6 times.

FIG. 8, a partial cross-section through the line 8-8 of FIG. 2A, shows a perspective detail view of the webbing 10 of the present invention embodying the webbing manufacturing in accordance with the specifications of FIGS. 5 and 6. The double 2×2 twill weave of the present invention can be seen as the center section 26. A plurality of warp threads 16 with warp ends 16*a* can be seen interwoven with weft thread 18 with weft ends in two layers, a top layer 32 and bottom layer 30, which are preferably of the same configuration and pattern but also may be different. The top layer 32 and bottom layer 30 are retained by a binder yarn 34 to provide the aforesaid repeating pattern (such as seven times) to, in turn, provide the center portion 26 of the webbing 10. The left edge 28*a* of the webbing 10 is shown for illustration purposes on the left side of FIG. 8. For ease of illustration, all of the repeated pattern is not shown but it should be understood that the pattern repeats to the right and then includes a right-side edge portion 28*b* that is of the same construction as the left-side edge portion 28*a* of the webbing.

The resultant webbing construction 10 of the present invention provides a non-stretchable, rigid webbing 10 without the use of additional reinforcing members, such as metal wire. Further the webbing construction 10 provides spaced apart ridges 36 at the edges 28*a* and 28 along the length of the webbing 10, as can best be seen in FIGS. 2A and 2B. For example, the ridges 36 can be spaced apart 1/32" on the edges 28*a*, 28*b*, and in some embodiments can be one or both edges 28*a*, 28*b*. Such ridges 36 enable the webbing construction 10 to be used in various applications that can take advantage of such spaced apart ridges 36, such as for control of slippage of the webbing 10 after installed.

For example, as seen in the examples of FIGS. 3 and 4, the ridges 36 of the webbing construction 10 of the present invention may be used to grip onto a buckle 14, namely against edges of slots 14*a* formed in the buckle 14 when routed through or in any other application, such as a seat belt, watch band, tie down, backpack and the like. In FIG. 4 a webbing style buckle 14 is shown with two slots 14*a* on opposing sides of the buckle 14. As can be understood from the operation of this buckle 14, webbing 10 is routed through the slots 14*a*, as seen in FIG. 3 and there is a desire to avoid slippage of the webbing 10 when routed through the belt buckle slots 14*a*. In FIG. 3, the ridges 36 on the left edge portion 28*a* and right edge portion 28*b* of the webbing 10 grip the belt buckle 14 to avoid the known slippage problem.

In view of the foregoing, the present invention provides an improved webbing construction 10 that has high resistance to abrasion absorbs stress and pressures on the edge portions 28*a*, 28*b* of the webbing 10 while reducing the memory of folds made over a long period of time. The present invention that meets all of the foregoing performance factors and needs of the webbing industry.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method for manufacturing an improved webbing construction having opposing longitudinal side edges, comprising the steps of:

providing vertical warp threads, passing each thread through a heddle; the heddle being separating the warp threads with unique design for the passage of the weft; the heddle being is suspended on a harness shaft of a loom;

moving the threads up or down by the shaft driven by a pattern chain;

providing a horizontal individual weft thread moving in and out into an open warp shed; and stitching on the right side by a latch needle and locked by a catch cord thread;

providing a center portion of a double 2×2 twill weave;

providing edge portions, on opposing sides of the center portion, of a double plain weave.

2. The method of claim 1, wherein the center double 2×2 twill weave includes 1680 denier yarn bounded together by 1680 denier 1×1 binder.

3. The method of claim 1, wherein the double plain weave edge portions of the webbing construction are of 840 denier yarn.

4. The method of claim 1, wherein one harness for binder, 8 harnesses for center body, 4 harnesses for edges are employed.

5. The method of claim 1, wherein a plurality of ridges is located on the opposing edge portions of the webbing.

6. The method of claim 5, wherein the ridges are spaced apart from each other by 1/32".

* * * * *